US009896627B2

(12) United States Patent
Koseoglu

(10) Patent No.: US 9,896,627 B2
(45) Date of Patent: Feb. 20, 2018

(54) PROCESSES AND SYSTEMS FOR FLUIDIZED CATALYTIC CRACKING

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 34 days.

(21) Appl. No.: 14/883,027

(22) Filed: Oct. 14, 2015

(65) Prior Publication Data

US 2017/0107430 A1 Apr. 20, 2017

(51) Int. Cl.
*C10G 11/18* (2006.01)
*C10G 51/02* (2006.01)

(52) U.S. Cl.
CPC ..... *C10G 11/182* (2013.01); *C10G 51/026* (2013.01)

(58) Field of Classification Search
CPC ..... C10G 11/182
See application file for complete search history.

(56) References Cited

U.S. PATENT DOCUMENTS

| | | | | |
|---|---|---|---|---|
| 3,186,805 | A | 6/1965 | Gomory | |
| 3,617,497 | A | 11/1971 | Bryson | |
| 3,821,103 | A | 6/1974 | Owen et al. | |
| 3,904,548 | A | 9/1975 | Fagan et al. | |
| 4,116,814 | A | 9/1978 | Zahner | |
| 4,749,470 | A | 6/1988 | Herbst et al. | |
| 4,802,971 | A | 2/1989 | Herbst et al. | |
| 4,927,522 | A | 5/1990 | Herbst et al. | |
| 5,009,769 | A | 4/1991 | Goelzer | |
| 5,506,365 | A * | 4/1996 | Mauleon | C10G 11/18 208/113 |
| 7,083,762 | B2 | 8/2006 | Kuechler et al. | |
| 7,220,351 | B1 | 5/2007 | Pontier et al. | |

(Continued)

FOREIGN PATENT DOCUMENTS

| | | | |
|---|---|---|---|
| CN | 1371960 | A | 3/2002 |
| CN | 10121091 | A | 7/2008 |

(Continued)

OTHER PUBLICATIONS

International Search Report and Written Opinion dated Jun. 13, 2016 pertaining to International Serial No. PCT/US2015/059454.

*Primary Examiner* — Randy Boyer
*Assistant Examiner* — Juan Valencia
(74) *Attorney, Agent, or Firm* — Dinsmore & Shohl LLP

(57) ABSTRACT

Methods and systems for cracking a light fuel fraction and a heavy fuel fraction by fluidized catalytic cracking are described herein. The method for cracking may include feeding the light fuel fraction and a catalyst from a catalyst regenerator into a first reactor, cracking the light fuel fraction in the first reactor to produce an at least partially cracked light fuel fraction, transporting the at least partially cracked light fuel fraction and the catalyst from the first reactor to a second reactor, feeding the heavy fuel fraction into the second reactor, cracking the heavy fuel fraction and the at least partially cracked light fuel fraction in the second reactor to produce at least a product fuel and a spent catalyst, and transporting the spent catalyst to the catalyst regenerator and regenerating the catalyst in the catalyst regenerator.

39 Claims, 1 Drawing Sheet

(56) References Cited

U.S. PATENT DOCUMENTS

| | | | | |
|---|---|---|---|---|
| 7,597,796 | B2 * | 10/2009 | Andreux | B01J 8/1818 208/113 |
| 8,163,247 | B2 | 4/2012 | Lomas et al. | |
| 2006/0138027 | A1 | 6/2006 | Soni et al. | |
| 2013/0001130 | A1 * | 1/2013 | Mo | C10G 11/18 208/79 |

FOREIGN PATENT DOCUMENTS

| | | | |
|---|---|---|---|
| EP | 0142900 | B1 | 8/1989 |
| EP | 0849347 | A2 | 6/1998 |
| EP | 0911308 | B1 | 11/2002 |
| WO | 2001070908 | A1 | 9/2001 |
| WO | 2013121433 | A1 | 8/2013 |

* cited by examiner

PROCESSES AND SYSTEMS FOR FLUIDIZED CATALYTIC CRACKING

BACKGROUND

Field

The present disclosure generally relates to processes and systems for chemical cracking of hydrocarbons, and more specifically, to processes and systems for fluidized catalytic cracking of hydrocarbons incorporating series-reactor fluidized catalytic cracking units.

Technical Background

Crude oils are refined to produce transportation fuels and petrochemical feedstocks. Typically fuels for transportation are produced by processing and blending of distilled fractions from the crude to meet the particular end use specifications. After initial atmospheric and/or vacuum distillation, fractions are converted into products by various catalytic and non-catalytic processes. Catalytic processes are generally categorized based on the presence or absence of reaction hydrogen. Processes including hydrogen, often broadly referred to as hydroprocessing, include, for example, hydrotreating primarily for desulfurization and denitrification, and hydrocracking for conversion of heavier compounds into lighter compounds more suitable for certain product specifications. Catalytic conversion of hydrocarbons without the addition of hydrogen is another type of process for certain fractions. The most widely used processes of this type are commonly referred to as fluidized catalytic cracking (FCC) processes. A feedstock is introduced to the conversion zone typically operating in the range of from about 480° C. to about 550° C. with a circulating catalyst stream. This mode has the advantage of being performed at relatively low pressure, i.e., 50 psig or less.

In FCC processes, the feed is catalytically cracked over a fluidized catalyst bed. The main product from such processes has conventionally been gasoline, although other products are also produced in smaller quantities via FCC processes such as liquid petroleum gas and cracked gas oil. Coke deposited on the catalyst is burned off in a regeneration zone at relatively high temperatures in the presence of air before being recycled back to the reaction zone.

BRIEF SUMMARY

In accordance with one embodiment of the present disclosure, a light fuel fraction and a heavy fuel fraction may be cracked by fluidized catalytic cracking. The cracking process may comprise feeding the light fuel fraction and a catalyst from a catalyst regenerator into a first reactor, and cracking the light fuel fraction in the first reactor to produce an at least partially cracked light fuel fraction. The first reactor may be a fluidized bed reactor. The process may further comprise transporting the at least partially cracked light fuel fraction and the catalyst from the first reactor to a second reactor, feeding the heavy fuel fraction into the second reactor, and cracking the heavy fuel fraction and the at least partially cracked light fuel fraction in the second reactor to produce at least a product fuel and a spent catalyst. The second reactor may be a fluidized bed reactor. The process may further comprise transporting the spent catalyst to the catalyst regenerator and regenerating the catalyst in the catalyst regenerator.

In accordance with another embodiment of the present disclosure, a system for cracking by fluidized catalytic cracking may comprise a first reactor, a second reactor, and a catalyst regenerator. The first reactor may be a fluidized bed reactor and may comprise a catalyst inlet and a light fuel fraction inlet. The second reactor may be a fluidized bed reactor and may be in fluidic communication with the first reactor and may comprise a heavy fuel fraction inlet. The catalyst regenerator may be in fluidic communication with the catalyst inlet of the first reactor. A catalyst may circulate from the catalyst regenerator to the first reactor to the second reactor and back to the catalyst regenerator. A light fuel fraction may be disposed in the first reactor and may react with the catalyst and be transported to the second reactor. A heavy fuel fraction may be disposed in the second reactor and may react with the catalyst.

Additional features and advantages of the technology disclosed herein will be set forth in the detailed description which follows, and in part will be readily apparent to those skilled in the art from that description or recognized by practicing the technology as described herein, including the detailed description which follows, the claims, as well as the appended drawings.

It is to be understood that both the foregoing general description and the following detailed description present embodiments of the technology, and are intended to provide an overview or framework for understanding the nature and character of the technology as it is claimed. The accompanying drawings are included to provide a further understanding of the technology, and are incorporated into and constitute a part of this specification. The drawings illustrate various embodiments and together with the description serve to explain the principles and operations of the technology. Additionally, the drawings and descriptions are meant to be merely illustrative, and are not intended to limit the scope of the claims in any manner.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 2:
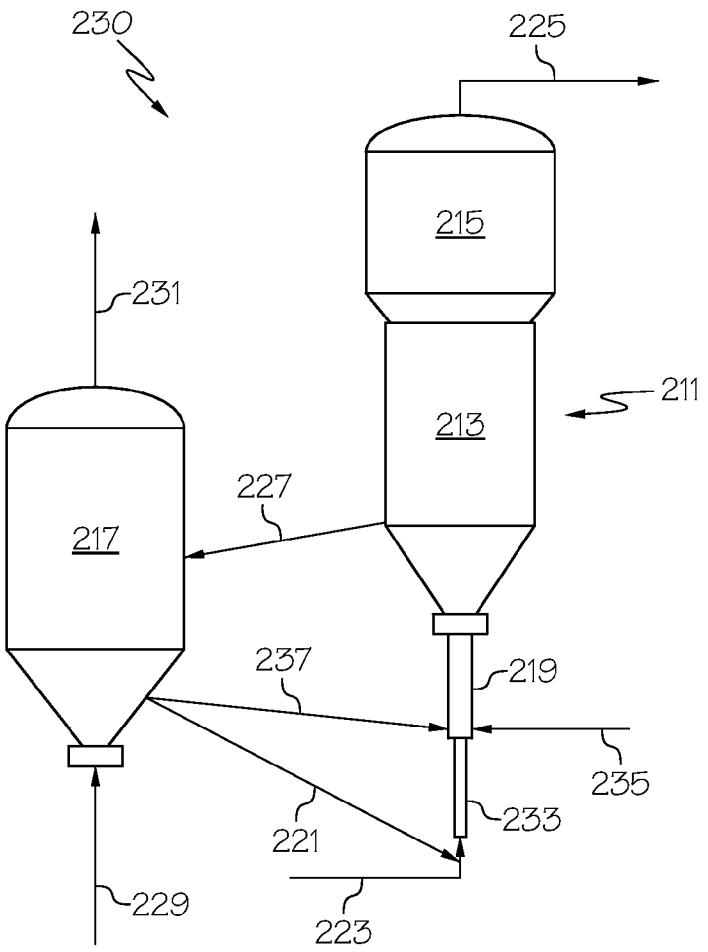
FIG. 2 is a generalized diagram of a series-riser FCC reactor apparatus, according to one or more embodiments described herein.

For the purpose of this simplified schematic illustration and description, the numerous valves, temperature sensors, electronic controllers and the like that are customarily employed and well known to those of ordinary skill in the art of certain refinery operations are not included. Further, accompanying components that are in conventional refinery operations including FCC processes such as, for example, air supplies, catalyst hoppers, and flue gas handling are not shown.

It should further be noted that arrows in the drawings refer to pipes, conduits, channels, or other physical transfer lines that connect by fluidic communication one or more system apparatuses to one or more other system apparatuses. Additionally, arrows that connect to system apparatuses define inlets and outlets in each given system apparatus.

DETAILED DESCRIPTION

Reference will now be made in greater detail to various embodiments, some embodiments of which are illustrated in the accompanying drawings. Whenever possible, the same reference numerals will be used throughout the drawings to refer to the same or similar parts. Generally, disclosed herein are various embodiments of systems and methods for cracking a light fuel fraction and a heavy fuel fraction in an integrated FCC unit. Generally, the FCC unit includes a first reactor and a second reactor arranged in series, where the first reactor and second reactor are fluidized bed reactors. Catalyst and the light fuel fraction are fed into the first reactor, and the light fuel fraction is at least partially cracked. The at least partially cracked light fuel fraction mixed with the catalyst from the first reactor is transported to the second reactor. The heavy fuel fraction is additionally fed into the second reactor. Optionally, additional fresh catalyst may be fed into the second reactor. In the second reactor, the partially cracked light fuel fraction and the heavy fuel fraction are cracked to form a desired product. The spent catalyst is separated from the product, is regenerated, and is again fed into the first reactor and optionally the second reactor.

As used herein, "fuel" may include: a solid carbonaceous composition such as coal, coal derived liquids, tars, oil shales, oil sands, tar sand, biomass, wax, coke, or the like; a liquid carbonaceous composition such as gasoline, oil, petroleum, diesel, jet fuel, ethanol, or the like; and a gaseous composition such as syngas, carbon monoxide, hydrogen, methane, gaseous hydrocarbon gases ($C_1$-$C_6$), hydrocarbon vapors, or the like.

As used herein, the "heavy fuel fraction" may be any fuel that is heavier than the "light fuel fraction." As used herein, a fuel is heavier than another fuel if it, on average, has a higher boiling point than another fuel, and a fuel is lighter than another fuel if, on average, it has a lower boiling point than another fuel. In one embodiment, the light fuel fraction may comprise or consist essentially of straight or cracked naphthas boiling from about 36° C. to about 230° C., distillate oils boiling from about 10° C. to about 400° C., or combinations thereof. In one embodiment, the heavy fuel fraction may comprise or consist essentially of vacuum distillates, such as vacuum gas oil (VGO), boiling from about 370° C. to about 565° C., hydrotreated residues such as atmospheric distillation residues or vacuum distillation residues, visbreaking or distillation residues boiling above about 520 C, or combinations thereof. The heavy fuel fraction and light fuel fraction may come from an external supply or may be delivered from a common distillation column. For example, the bottoms fraction from a distillation column may serve as the heavy fuel fraction to the FCC unit, alone or in combination with an additional feed. A higher fraction from a distillation column may serve as the light fuel fraction to the FCC unit, alone or in combination with an additional feed.

As used herein, the term "downer" refers to a reactor, such as a fluidized bed reactor, where the reactant flows in a generally downward direction such as, for example, entering the top and exiting the bottom of the reactor. Downers may be utilized in embodiments of down-flow FCC reactor apparatuses described herein. Likewise, the term "riser" refers to a reactor, such as a fluidized bed reactor, where the reactant flows in a generally upward direction such as, for example, entering the bottom and exiting the top of the reactor. Downers may be utilized in embodiments of up-flow FCC reactor apparatuses described herein.

As used herein, "spent catalyst" refers to catalyst which has undergone reaction with fuel and is at least partially coked. Also, as used herein, "regenerated catalyst" refers to catalyst that is exiting the catalyst regenerator and is at least partially or substantially free of coke, and "fresh catalyst" refers to catalyst that is newly entering the system and is at least partially or substantially free of coke.

Embodiments of series-reactor FCC units and processes and methods incorporating the series-reactor FCC units will now be described. In exemplary embodiments, the series-reactor FCC unit may be a series-downer FCC unit, described below with reference to FIG. 1, or a series-riser FCC unit, described below with reference to FIG. 2. Both the series-downer FCC unit and the series-riser FCC unit may include two FCC reactors configured in series, such that a light fuel fraction is resident in a first reactor and is at least partially cracked before being transferred to a second reactor. In the second reactor, the at least partially cracked light fuel fraction may be further cracked together with a heavy fuel fraction.

Figure 1:
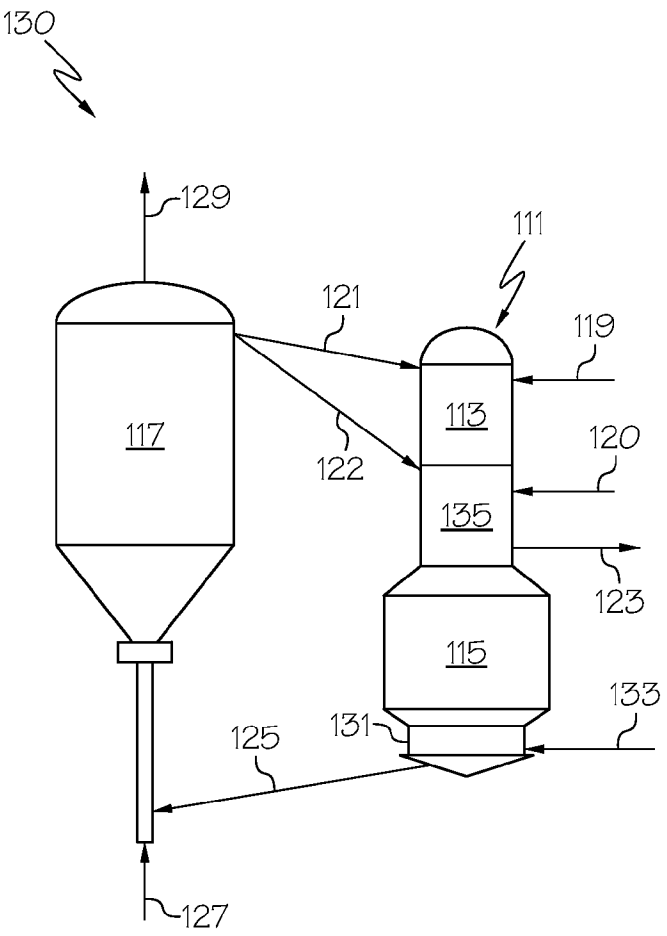
FIG. 1 is a generalized diagram of a series-downer FCC reactor apparatus, according to one or more embodiments described herein.

Referring to the process-flow diagram of FIG. 1, a series-downer FCC unit 130 may include two downer reactors. The series-downer FCC unit 130 may be used in the processes described herein. The series-downer FCC unit 130 includes a reactor/separator unit 111 comprising a first reactor 113, a second reactor 135, and a separation zone 115. The series-downer FCC unit 130 also includes a catalyst regenerator 117 for regenerating spent catalyst. Catalyst may generally circulate through the catalyst regenerator 117, into the first reactor 113, into the second reactor 135, and back into the catalyst regenerator 117.

During operation of the series-downer FCC unit 130, a light fuel fraction is introduced as a feed into the first reactor 113 through a transfer line 119. In some embodiments, the light fuel fraction may be introduced into the first reactor 113 with steam or other suitable gas for atomization of the feed. A quantity of heated fresh or hot regenerated solid cracking catalyst particles from the catalyst regenerator 117 may also be transferred to a withdrawal well or hopper (not shown) at the top of the first reactor 113. Fresh catalyst may be heated from an energy source and the regenerated catalyst may be heated by oxidation reactions to remove coke. The quantity of catalyst may be sufficient to crack the light fuel fraction to a desired product. The catalyst particles may be transferred, for example, through a downwardly directed transfer line 121 such as a conduit or pipe, commonly referred to as a transfer line or standpipe. Hot catalyst flow may be allowed to stabilize to ensure the hot catalyst is uniformly directed into a mixing zone or a feed injection portion of the first reactor 113. In some embodiments, transfer line 121 and/or transfer line 119 are oriented relative to the first reactor 113 to introduce the catalyst and light fuel fraction, respectively, into the upper portion or top of the first reactor 113.

The light fuel fraction may be injected into a mixing zone of the first reactor 113. For example, the light fuel fraction may enter the first reactor 113 through feed injection nozzles. In some embodiments, the feed injection nozzles may be situated proximate to where the regenerated catalyst particles are introduced into the first reactor 113. In some embodiments, for example, multiple injection nozzles may be used to aid thorough and uniform mixing of the light fuel fraction and the catalyst. When the light fuel fraction contacts hot catalyst in the first reactor 113, cracking reactions begin to occur. The reaction vapor of hydrocarbon cracked products, unreacted feed, and catalyst mixture quickly flow through the remainder of the first reactor 113 and into the second reactor 135. In some embodiments, the second reactor 135 may be a downer. In some embodiments, both the first reactor 113 and the second reactor 135 may be downers.

In some embodiments, the first reactor 113 and the second reactor 135 are configured in series, whereby a first reaction is conducted in the first reactor 113, at least a portion of the products from the first reaction are transferred to the second reactor 135, and a second reaction occurs in the second reactor 135. In some embodiments, configuration in series may include the first reactor 113 and the second reactor 135 being adjacent to one another, with a suitable fluidic connection allowing for fluidic communication between the first reactor 113 and the second reactor 135, such as an outlet in the first reactor 113 that leads directly into an inlet in the second reactor 135. In such embodiments, the first reactor 113 and the second reactor 135 may be in physical contact with each other, but need not necessarily be in physical contact with each other. For example, the first reactor 113 and the second reactor 135 may be divided by a partition in a tank, drum, vessel, or other like reactor. In other embodiments, configuration in series may include a connection line or conduit from the first reactor 113 to the second reactor 135. In such embodiments, the first reactor 113 may be physically isolated the second reactor 135.

During operation of the series-downer FCC unit 130, the heavy fuel fraction may be injected via a transfer line 120 into the second reactor 135. In some embodiments, the heavy fuel fraction may be mixed with steam or another suitable gas for atomization of the feed when the heavy fuel fraction is injected into the second reactor 135. The heavy fuel fraction may be injected into the second reactor 135 by any suitable means such as through feed injection nozzles, for example. The second reactor 135 may include a mixing zone, into which the heavy fuel fraction is injected. In one embodiment, the second reactor 135 may receive additional fresh catalyst through a transfer line 122 having an inlet to the second reactor 135 near where the products of the first reactor 113 are introduced into the second reactor 135. Separate injections of the fresh catalyst from transfer line 121, of the at least partially cracked light fuel fraction product mixed with catalyst of the first reactor 113, and of the heavy fuel fraction from the transfer line 120 may facilitate thorough and uniform mixing of the reaction components in the second reactor 135. As used herein, "at least partially cracked light fuel fraction" refers to a light fuel fraction for which at least some cracking has occurred (for example, in the first reactor 113), but for which cracking not necessarily occurred to a desired final amount. In some embodiments, further cracking of the light fuel fraction takes place in the second reactor 135. Once the heavy fuel fraction contacts the catalyst in the second reactor 135, cracking reactions occur in one or both of the heavy fuel fraction and the at least partially cracked light fuel fraction. In some embodiments, transfer line 122 and/or transfer line 120 are oriented relative to the second reactor 135 to introduce the catalyst and heavy fuel fraction, respectively, into the upper portion or top of the first reactor 113.

As cracking occurs in the second reactor 135, the reaction vapors of hydrocarbon cracked products, of unreacted feed, and of catalyst mixture quickly flow through the remainder of the second reactor 135 and into a rapid separation zone 115 at a bottom portion of reactor/separator unit 111. Cracked and uncracked hydrocarbons may be directed through a conduit or pipe 123 to a conventional product recovery section known in the art.

If necessary for temperature control, a quench injection may be provided near the bottom of the second reactor 135 immediately before the separation zone 115. This quench injection quickly reduces or stops the cracking reactions and can be utilized for controlling cracking severity, for example, to increase process flexibility.

The reaction temperature in the first reactor 113, i.e., the outlet temperature of the first reactor 113, may be controlled by opening and closing a catalyst slide valve (not shown) that controls a flow of regenerated catalyst from the catalyst regenerator 117 into the top of first reactor 113. In embodiments in which fresh catalyst is injected into the second reactor 135 through the transfer line 122, the reaction temperature of the second reactor 135 may also be controlled by the flow rate of catalyst into the second reactor 135. At least a portion of the heat required for the endothermic cracking reaction may be supplied by the regenerated catalyst which has acquired heat in the regeneration process in the catalyst regenerator 117. By changing the flow rate of the hot regenerated catalyst, the operating severity or cracking conditions can be controlled in the first reactor 113 and/or second reactor 135 to produce the desired yields of fuel products such as, for example, light olefinic hydrocarbons and gasoline as products of the first reactor 113, the second reactor 135, or both.

The series-downer FCC unit 130, for example in the reactor/separator unit 111, may include a stripper 131 for separating fuel from spent catalyst. After passing through the stripper 131, the spent catalyst may be transferred to the catalyst regenerator 117. The catalyst from separation zone 115 flows to the lower section of the stripper 131 that includes a catalyst stripping section into which a suitable stripping gas, such as steam, is introduced through transfer line 133. The stripper 131 may include several baffles or structured packing (not shown), over which the downwardly flowing spent catalyst passes counter-currently to the flowing stripping gas. The upwardly flowing stripping gas, which is typically steam, is used to "strip" or remove any additional hydrocarbons that remain in the catalyst pores or between catalyst particles.

In the series-downer FCC unit 130, the stripped or spent catalyst may be transported through transfer line 125, for example, by lift forces from combustion air supplied through transfer line 127 and into the bottom portion of the catalyst regenerator 117. This spent catalyst, which can also be contacted with additional combustion air, undergoes controlled combustion, through which any accumulated coke on the spent catalyst is burned off. Flue gases are removed from the catalyst regenerator 117 via conduit 129. In the catalyst regenerator 117, the heat produced from the combustion of the by-product coke may be transferred to the first reactor 113 and optionally the second reactor 135 through the catalyst in transfer line 121 and transfer line 122, respectively. Thereby, at least a portion of the thermal energy required for the endothermic cracking reaction in the first reactor 113 and/or the second reactor 135 may be provided from heat produced during catalyst regeneration in the catalyst regenerator 117.

Important properties of series-downer reactors (i.e., downers) in general include introduction of feed at the top of the reactor with downward flow, shorter residence time as compared to up-flow reactors (i.e., risers), and high catalyst to fuel ratio, e.g., in the range of from about 20:1 to about 30:1.

In general, the operating conditions for the first reactor 113 and/or second reactor 135 of a suitable series-downer FCC unit 130 include: a reaction temperature of from about 550° C. to about 700° C., in certain embodiments about 580° C. to about 630° C., and in further embodiments about 590° C. to about 620° C.; reaction pressure of from about 1 $kg/cm^2$ to about 20 $kg/cm^2$, in certain embodiments about 1 kg/cm$^2$ to about 10 kg/cm$^2$, in further embodiments about 1 kg/cm$^2$ to about 3 kg/cm$^2$; contact time (in the reactor) of from about 0.1 seconds to about 30 seconds, in certain embodiments about 0.1 seconds to about 10 seconds, and in further embodiments about 0.2 seconds to about 0.7 seconds; and a catalyst-to-feed ratio of from about 1:1 to about 60:1, in certain embodiments about 1:1 to about 30:1, and in further embodiments about 10:1 to about 30:1.

Referring to the generalized process flow diagram of FIG. 2, a series-riser FCC unit 230 and may be used in the systems and processes according to the present disclosure may include two riser reactors. The two risers may include a first reactor 233 and a second reactor 219 in series. The series-riser FCC unit 230 includes a reactor/separator 211 having the first reactor 233, the second reactor 219, a reaction zone 213, and a separation zone 215. The series-riser FCC unit 230 also includes a catalyst regenerator 217 for regenerating spent catalyst.

A light fuel fraction may be conveyed as a feed to the first reactor 233 via a transfer line 223. In some embodiments, the light fuel fraction may be accompanied in the transfer line 223 by steam or other suitable gas for atomization of the feed. Atomization of the feed may facilitate admixture and intimate contact with a quantity of heated fresh or regenerated solid cracking catalyst particles sufficient for desired cracking of the light fuel fraction in the first reactor 233. The catalyst particles may be conveyed to the first reactor 233 via transfer line 221 from the catalyst regenerator 217. The light fuel fraction and the cracking catalyst are contacted under conditions to form a suspension that is introduced into the first reactor 233.

In a continuous process using the series-riser FCC unit 230, the mixture of cracking catalyst and light fuel fraction proceed upward through the first reactor 233. In the first reactor 233 the hot cracking catalyst particles catalytically crack hydrocarbon molecules by carbon—carbon bond cleavage. The reaction vapor of hydrocarbon cracked products, unreacted feed, and catalyst mixture quickly flows through the remainder of the first reactor 233 and into the second reactor 219. In some embodiments, configuration in series may include the first reactor 233 and the second reactor 219 being adjacent to one another, with a suitable fluidic connection allowing for fluidic communication between the first reactor 233 and the second reactor 219, such as an outlet in the first reactor 233 that leads directly into an inlet in the second reactor 219. In such embodiments, the first reactor 233 and the second reactor 219 may be in physical contact with each other, but need not necessarily be in physical contact with each other. For example, the first reactor 233 and the second reactor 219 may be divided by a partition in a tank, drum, vessel, or other like reactor. In other embodiments, configuration in series may include a connection line or conduit from the first reactor 233 to the second reactor 219. In such embodiments, the first reactor 233 may be physically isolated the second reactor 219.

In the continuous process using the series-riser FCC unit 230, the heavy fuel fraction is injected as a feed into the second reactor 219 through transfer line 235. In certain embodiments, the heavy fuel fraction may be injected using steam or another suitable gas for atomization of the feed. In one embodiment, the second reactor 219 may receive additional fresh catalyst through a transfer line 237 having an inlet to the second reactor 219 near where the products of the first reactor 233 are introduced into the second reactor 219. The at least partially cracked light fuel fraction from the first reactor 233, itself mixed with catalyst involved in the reaction that occurred in the first reactor 233, mixes thoroughly and uniformly in the second reactor 219 with the heavy fuel fraction from the transfer line 237. Once the heavy fuel fraction contacts the catalyst in the second reactor 219, cracking reactions occur. Additionally, the at least partially cracked light fuel fraction (the product of the first reactor 233) may be further cracked in the second reactor 219. The reaction vapor of hydrocarbon cracked products, unreacted feed, and catalyst mixture quickly flows through the remainder of the second reactor 219. As the reaction proceeds, the reacting components are moved upward through the riser.

During the reactions in the first reactor 233, the second reactor 219, and the reaction zone 213, as is conventional in FCC operations, the cracking catalysts may become coked. In coked catalysts, access to active catalytic sites is limited or nonexistent. Reaction products from the series-riser FCC unit 230 may be separated from the coked catalyst using any suitable configuration known in FCC units, generally referred to as the separation zone 215 in series-riser FCC unit 230, for instance, located at the top of the reactor/separator 211 above the reaction zone 213. The separation zone 215 can include any suitable apparatus known to those of ordinary skill in the art such as, for example, cyclones. The reaction product may be withdrawn through transfer line 225.

Catalyst particles containing coke deposits from fluid cracking of the hydrocarbon feedstock pass from the reaction zone 213 and/or separation zone 215 through a transfer line 227 to the catalyst regenerator 217. In the catalyst regenerator 217, the coked catalyst contacts a stream of oxygen-containing gas, e.g., pure oxygen or air, which enters the catalyst regenerator 217 via a transfer line 229. The catalyst regenerator 217 may be operated in a configuration and under conditions that are known in typical FCC operations. For instance, catalyst regenerator 217 can operate as a fluidized bed to produce regeneration off-gas comprising combustion products that is discharged through a transfer line 231. The hot regenerated catalyst may be transferred from catalyst regenerator 217 through transfer line 221 and optionally through transfer line 237 to the bottom portion of the first reactor 233 and bottom portion of the second reactor 219, respectively, for admixture with the hydrocarbon feedstock (i.e., the light fuel fraction or the heavy fuel fraction) as noted above.

In general, the operating conditions for the first reactor 233 and/or second reactor 219 of a suitable series-riser FCC unit 230 include: reaction temperature of from about 480° C. to about 700° C., in certain embodiments about 500° C. to about 620° C., and in further embodiments about 500° C. to about 600° C.; reaction pressure of from about 1 kg/cm$^2$ to about 20 kg/cm$^2$, in certain embodiments about 1 kg/cm$^2$ to about 10 kg/cm$^2$, in further embodiments about 1 kg/cm$^2$ to about 3 kg/cm$^2$; contact time (in the reactor) of from about 0.1 seconds to about 10 seconds, in certain embodiments about 1 second to about 5 seconds, and in further embodiments about 1 second to about 2 seconds; and a catalyst to feed ratio of from about 1:1 to about 60:1, in certain embodiments about 1:1 to about 10:1, and in further embodiments about 8:1 to about 20:1.

A catalyst that is suitable for the particular charge and the desired product may be conveyed to the fluidized catalytic cracking reactor or reactors. In certain embodiments, to promote formation of olefins and minimize olefin-consuming reactions, such as hydrogen-transfer reactions, an FCC catalyst mixture is used in the FCC unit, including an FCC base cracking catalyst and an FCC catalyst additive.

In particular, a matrix of an FCC base cracking catalyst may include natural or synthetic zeolites including one or more Y-zeolite, clays such as kaolin, montmorilonite, halloysite and bentonite, and/or one or more inorganic porous oxides such as alumina, silica, boria, chromia, magnesia, zirconia, titania and silica-alumina. A suitable FCC base cracking catalyst may have a bulk density of 0.5 g/mL to 1.0 g/mL, an average particle diameter of 50 μm to 90 μm, a surface area of 50 $m^2/g$ to 350 $m^2/g$ and a pore volume of 0.05 mL/g to 0.5 mL/g.

A suitable FCC catalyst mixture may contain, in addition to an FCC base cracking catalyst, an FCC catalyst additive containing a shape-selective zeolite. The shape selective zeolite referred to herein means a zeolite having a pore diameter is smaller than that of Y-type zeolite, so that hydrocarbons with only limited shape can enter the zeolite through its pores. Suitable shape-selective zeolite components include ZSM-5 zeolite, zeoliteomega, SAPO-5 zeolite, SAPO-11 zeolite, SAPO34 zeolite, and pentasil-type aluminosilicates, for example. The content of the shape-selective zeolite in the FCC catalyst additive is generally in the range of from about 20 wt. % to 70 wt. %, and in certain embodiments from about 30 wt. % to 60 wt. %.

A suitable FCC catalyst additive may have a bulk density of 0.5 g/mL to 1.0 g/mL, an average particle diameter of 50 μm to 90 μm, a surface area of 10 $m^2/g$ to 200 $m^2/g$, and a pore volume of 0.01 mL/g to 0.3 mL/g.

In some embodiments, the FCC catalyst mixture may contain from 60 wt. % to 95 wt. % FCC base cracking catalyst, based on the total weight of the FCC catalyst mixture. The FCC catalyst mixture may contain from 5 wt. % to 40 wt. % FCC catalyst additive, based on the total weight of the FCC catalyst mixture. If the weight fraction of the FCC base cracking catalyst in the FCC catalyst mixture is lower than 60 wt. %, or if the weight fraction additive in the FCC catalyst mixture is higher than 40 wt. %, the yield of light-fraction olefin may not be optimal, because of low conversions of the feed fuels (i.e., the heavy fuel fraction and/or light fuel fraction). If the weight fraction of the FCC base cracking catalyst in the FCC catalyst mixture is higher than 95 wt. %, or if the weight fraction of the FCC catalyst additive in the FCC catalyst mixture is lower than 5 wt. %, the yield of light-fraction olefin may not be optimal, despite high conversion of the feed fuels.

In processes incorporating series-reactor FCC units according to embodiments herein, such as the series-downer FCC unit 130 of FIG. 1 or the series-riser FCC unit 230 of FIG. 2, for example, a total residence time of the light fuel fraction includes a first average reaction time in the first reactor 113, 233 and a second average reaction time in the second reactor 135, 219. On the other hand, a total residence time of the heavy fuel fraction includes only a single average reaction time in the second reactor 135, 219. Moreover, the single average reaction time of the heavy fuel fraction in the second reactor 135, 219, occurs together with the second average reaction time of the light fuel fraction, which also is being cracked in the second reactor 135, 219. Thus, the total residence time of the light fuel fraction in the series-reactor FCC units is longer than the total residence time of the heavy fuel fraction. Accordingly, the series-reactor FCC units may have a residence-time ratio equal to the ratio of the total residence time of the light fuel fraction to the total residence time of the heavy fuel fraction. In various embodiments, the series-reactor FCC units according to embodiments herein may have residence-time ratio of at least 1, at least 2, at least 5, or at least 10, such as, for example, from 1 to 20, from 2 to 20, from 2 to 10, from 2 to 5, or from 5 to 20, for example. Without intent to be bound by theory, it is believed that a residence-time ratio in the ranges described above is exemplary because light and heavy fuel fractions have different reactivities. For example, naphtha may be less reactive than VGO and may require a higher residence time to react.

In processes incorporating series-reactor FCC units according to embodiments herein, such as the series-downer FCC unit 130 of FIG. 1 or the series-riser FCC unit 230 of FIG. 2, for example, the series-reactor FCC unit during a particular process may have a catalyst-to-light fuel ratio that is greater than a catalyst-to-heavy fuel ratio.

The catalyst-to-light fuel ratio is the weight ratio of the FCC catalyst to the light fuel fraction. The catalyst-to-light fuel ratio is determined by dividing the total flow rate of catalyst from the catalyst regenerator 117, 217 into the first reactor 113, 233 and/or second reactor 135, 219 by the flow rate of the light fuel fraction entering the first reactor 113, 233. For example, in embodiment where regenerated catalyst enters directly into the first reactor 113, 233 and second reactor 135, 219, the catalyst-to-light fuel ratio is calculated as the sum of the flow rates of (1) the FCC catalyst entering the first reactor 113, 233 from the catalyst regenerator 117, 217 and (2) the catalyst entering the second reactor from the catalyst regenerator 117, 217 by the flow rate of the light fuel fraction entering the first reactor 113, 233. In embodiments where regenerated catalyst enters only directly into the first reactor 113, 233, the catalyst-to-light fuel ratio is calculated as the flow rate of the FCC catalyst entering the first reactor 113, 233 divided by the flow rate of the light fuel fraction entering the first reactor 113, 233.

The catalyst-to-heavy fuel ratio is the weight ratio of the FCC catalyst to the heavy fuel fraction. The catalyst-to-heavy fuel ratio is determined by dividing the total flow rate of catalyst from the catalyst regenerator 117, 217 into the first reactor 113, 233 and/or second reactor 135, 219 by the flow rate of the heavy fuel fraction entering the first reactor 113, 233. For example, in embodiment where regenerated catalyst enters directly into the first reactor 113, 233 and second reactor 135, 219, the catalyst-to-heavy fuel ratio is calculated as the sum of the flow rates of (1) the FCC catalyst entering the first reactor 113, 233 from the catalyst regenerator 117, 217 and (2) the catalyst entering the second reactor from the catalyst regenerator 117, 217 by the flow rate of the heavy fuel fraction entering the second reactor 135, 219. In embodiments where regenerated catalyst enters only directly into the first reactor 113, 233, the catalyst-to-light fuel ratio is calculated as the flow rate of the FCC catalyst entering the first reactor 113, 233 divided by the flow rate of the heavy fuel fraction entering the second reactor 135,219.

A unit catalyst ratio is defined as the ratio of the catalyst-to-light fuel ratio and the catalyst-to-heavy fuel ratio. In exemplary embodiments of the series-reactor FCC units described above, processes incorporating the series-reactor FCC units may have a unit catalyst ratio greater than 1, greater than 1.5, greater than 2, greater than 5, or greater than 10, such as from 1.1 to 20, from 2 to 20, from 2 to 10, from 2 to 5, or from 5 to 20, for example. Without intent to be bound by theory, it is believed that a unit catalyst ratio in the ranges described above is exemplary because light and heavy fuel fractions have different reactivities with the catalyst. For example, naphtha may be less reactive than VGO and require relatively more catalyst to react.

While FIGS. 1 and 2 depict embodiments of systems that include two reactors, it is contemplated herein that the FCC units may comprise more than two reactors in series, such as, but not limited to, three, four, or even five reactors arranged in series. Additionally, it should be understood that the systems described herein are not limited to two downers or two risers is series. For example, one or more risers and one or more downers connected in series are contemplated herein, such as a riser and downer in series or a downer and riser is series.

EXAMPLES

The various embodiments of methods and systems for the cracking of a light fuel fraction and a heavy fuel fraction by fluidized catalytic cracking will be further clarified by the following examples. The examples are illustrative in nature, and should not be understood to limit the subject matter of the present disclosure.

Example 1

A light straight run naphtha (LSRN), the composition of which is given in Table 1, was cracked in a microactivity test unit (MAT unit) using ASTM method D3907 at high severity FCC conditions. The naphtha was cracked at 650° C. and 48 catalyst-to-fuel ratio. The light naphtha was converted and yielded products as shown in Table 2.

TABLE 1

| wt. % | n-Paraffins | Iso-Paraffins | Olefins | Naphthenes | Aromatics | Total |
|---|---|---|---|---|---|---|
| C-4 | 0 | 0 | 0 | 0 | 0 | 0.0 |
| C-5 | 28.8 | 8.0 | 0 | 2.2 | 0 | 39.0 |
| C-6 | 26.4 | 27.7 | 1.4 | 3.5 | 0 | 59.1 |
| C-7 | 0 | 0.58 | 1.3 | 0 | 0 | 1.9 |
| C-8 | 0 | 0 | 0 | 0 | 0 | 0 |
| Total | 55.2 | 36.4 | 2.7 | 5.7 | 0 | 100.0 |

TABLE 2

| Feedstock | LSRN |
|---|---|
| conversion, wt. % | 33.47 |
| C3 =, wt. % | 11.60 |
| Total Remaining Gas, wt. % | 21.39 |
| Gasoline, wt. % | 66.53 |
| LCO, wt. % | 0.00 |
| HCO, wt. % | 0.00 |
| Coke, wt. % | 0.48 |
| Total, wt. % | 100.00 |

Example 2

A hydrotreated vacuum gas oil, properties of which are given in Table 3A and 3B, was cracked in a MAT test unit using ASTM method D3907 at high severity FCC conditions. Table 3A provides various properties of the vacuum gas oil and Table 3B reports the temperature at which a specified volume percentage of the vacuum gas oil boils. The hydrotreated vacuum gas oil was cracked at 650° C. and 5.8 catalyst-to-fuel ratio. The product yields are shown in Table 4.

TABLE 3A

| | |
|---|---|
| Specific gravity | 0.8967 |
| Sulfur, wt ppm (1) | <300 |
| Nitrogen, wt ppm | <170 |

TABLE 3A-continued

| | |
|---|---|
| Total Aromatics, % wt (2) | 38.5 |
| Conradson carbon, % wt | <0.2 |
| Watson K factor (3) | 12.17 |
| Ni (ICP), ppm wt | <0.1 |
| V (ICP), ppm wt | <0.2 |

TABLE 3B

| Distillation % vol (ASTM D1160) | Temperature |
|---|---|
| 0% (initial boiling point) | 364° C. |
| 5% | 382° C. |
| 10% | 388° C. |
| 30% | 417° C. |
| 50% | 444° C. |
| 70% | 480° C. |
| 90% | 541° C. |
| 95% | 564° C. |

TABLE 4

| Feedstock | Hydrotreated VGO |
|---|---|
| Conversion, wt. % | 87.56 |
| C3 =, wt. % | 25.49 |
| Total Remaining Gas, wt. % | 38.60 |
| Gasoline, wt. % | 21.83 |
| LCO, wt. % | 8.62 |
| HCO, wt. % | 3.82 |
| Coke, wt. % | 1.64 |
| Total, wt. % | 100.00 |

Example 3

A hydrotreated vacuum gas oil (100 parts by volume) (shown in FIG. 3) and straight run naphtha (10 parts by volume), properties of which are shown in Tables 1 and 3, were cracked in separate reactors in series (naphtha followed by VGO) in high severity FCC conditions. Both feedstocks were cracked at 650° C., with a catalyst-to-light fuel ratio of 50 and a catalyst-to-heavy fuel ratio of 6. The product yields are shown in Table 5.

TABLE 5

| Feedstock | Yields |
|---|---|
| Conversion, W % | 90.91 |
| $C_3$ =, W % | 26.65 |
| Total Remaining Gas, W % | 40.74 |
| Gasoline, W % | 28.48 |
| LCO, W % | 8.62 |
| HCO, W % | 3.82 |
| Coke, W % | 1.69 |
| Total, W % | 110.00 |

Based on the foregoing, it should now be understood that various aspects of method and systems for cracking light fuel fractions and heavy fuel fractions by fluidized catalytic cracking are disclosed herein. According to a first aspect of the present disclosure, a light fuel fraction and a heavy fuel fraction may be cracked by fluidized catalytic cracking. The cracking process may comprise feeding the light fuel fraction and a catalyst from a catalyst regenerator into a first reactor, and cracking the light fuel fraction in the first reactor to produce an at least partially cracked light fuel fraction. The first reactor may be a fluidized bed reactor. The process may further comprise transporting the at least partially cracked light fuel fraction and the catalyst from the first reactor to a second reactor, feeding the heavy fuel fraction into the second reactor, and cracking the heavy fuel fraction and the at least partially cracked light fuel fraction in the second reactor to produce at least a product fuel and a spent catalyst. The second reactor may be a fluidized bed reactor. The process may further comprise transporting the spent catalyst to the catalyst regenerator and regenerating the catalyst in the catalyst regenerator.

In a second aspect, a system for cracking by fluidized catalytic cracking may comprise a first reactor, a second reactor, and a catalyst regenerator. The first reactor may be a fluidized bed reactor and may comprise a catalyst inlet and a light fuel fraction inlet. The second reactor may be a fluidized bed reactor and may be in fluidic communication with the first reactor and may comprise a heavy fuel fraction inlet. The catalyst regenerator may be in fluidic communication with the catalyst inlet of the first reactor. A catalyst may circulate from the catalyst regenerator to the first reactor to the second reactor and back to the catalyst regenerator. A light fuel fraction may be disposed in the first reactor and may react with the catalyst and be transported to the second reactor. A heavy fuel fraction may be disposed in the second reactor and may react with the catalyst.

A third aspect includes the method of the first aspect, further comprising transporting additional catalyst from the catalyst regenerator to the second reactor.

A fourth aspect includes the method of the first aspect or the system of the second aspect, wherein both the first reactor and the second reactor may be downers.

A fifth aspect includes the method of the first aspect or the system of the second aspect, wherein both the first reactor and the second reactor may be risers.

A sixth aspect includes the method of the first aspect or the system of the second aspect, wherein: a sum of a first average reaction time of the light fuel fraction in the first reactor and a second average reaction time of the at least partially cracked light fuel fraction in the second reactor defines a total residence time of the light fuel fraction; a single average reaction time of the heavy fuel fraction in the second reactor defines a residence time of the heavy fuel fraction; a ratio of the total residence time of the light fuel fraction and the residence time of the heavy fuel fraction defines a residence-time ratio; and the residence-time ratio is from about 1 to about 10.

A seventh aspect includes the method of the first aspect or the system of the second aspect, wherein the light fuel fraction comprises straight or cracked naphthas with boiling points from about 36° C. to about 250° C., distillate oils with boiling points from about 10° C. to about 400° C., or combinations thereof.

An eighth aspect includes the method of the first aspect or the system of the second aspect, wherein the heavy fuel fraction comprises vacuum distillates with boiling points from about 370° C. to about 565° C., residues with boiling points above 520° C., or combinations thereof, the residues being chosen from hydrotreated residues, atmospheric distillation residues, vacuum distillation residues, visbreaking residues, distillation residues, or combinations thereof.

A ninth aspect includes the method of the first aspect, further comprising atomizing the light fuel fraction before feeding the light fuel fraction into the first reactor, and atomizing the heavy fuel fraction before feeding the heavy fuel fraction into the second reactor A tenth aspect includes the method of the first aspect or the system of the second aspect, wherein the products are light olefins ($C_2$-$C_4$), and/or gasoline.

An eleventh aspect includes the method of the first aspect or the system of the second aspect, wherein the spent catalyst is separated from other products of the second reactor in a separation zone.

A twelfth aspect includes the method of the first aspect or the system of the second aspect, wherein the spent catalyst is separated from other products of the second reactor in a separation zone A thirteenth aspect includes the system of the second aspect further comprising a transfer line connecting the catalyst regenerator and the second reactor.

A fourteenth aspect includes the system of the second aspect, wherein the light fuel fraction in the first reactor is atomized.

A fifteenth aspect includes the method of the first aspect or the system of the second aspect, wherein at least a portion of the catalyst in the second reactor is spent catalyst comprising coke deposits For the purposes of describing and defining the present disclosure it is noted that the term "about" are utilized herein to represent the inherent degree of uncertainty that may be attributed to any quantitative comparison, value, measurement, or other representation. The term "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated herein.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Rather, the claims appended hereto should be taken as the sole representation of the breadth of the present disclosure and the corresponding scope of the various embodiments described herein. Further, it will be apparent that modifications and variations are possible without departing from the scope of the appended claims.

What is claimed is:

1. A method of cracking a light fuel fraction and a heavy fuel fraction by fluidized catalytic cracking, the method comprising:

feeding the light fuel fraction and a catalyst from a catalyst regenerator into a first reactor, wherein the first reactor is a fluidized bed reactor;

cracking the light fuel fraction in the first reactor to produce an at least partially cracked light fuel fraction;

transporting the at least partially cracked light fuel fraction and the catalyst from the first reactor to a second reactor, wherein the second reactor is a fluidized bed reactor; feeding the heavy fuel fraction into the second reactor;

cracking the heavy fuel fraction and the at least partially cracked light fuel fraction in the second reactor to produce at least a product fuel and a spent catalyst;

transporting the spent catalyst to the catalyst regenerator and regenerating the catalyst in the catalyst regenerator;

wherein one or both of a residence-time ratio is from about 1 to about 10 or a unit catalyst ratio is from about 1 to about 10, wherein:

a sum of a first average reaction time of the light fuel fraction in the first reactor and a second average reaction time of the at least partially cracked light fuel fraction in the second reactor defines a total residence time of the light fuel fraction;

a single average reaction time of the heavy fuel fraction in the second reactor defines a residence time of the heavy fuel fraction;

a ratio of the total residence time of the light fuel fraction and the residence time of the heavy fuel fraction defines the residence-time ratio;

the flow rate of the catalyst entering the first reactor and/or the second reactor from the catalyst regenerator divided by the flow rate of the light fuel fraction entering the first reactor defines the catalyst-to-light fuel ratio;

the flow rate of the catalyst entering the first reactor and/or the second reactor from the catalyst regenerator divided by the flow rate of the heavy fuel fraction entering the second reactor defines the catalyst-to-heavy fuel ratio;

a ratio of the catalyst-to-light fuel ratio to the catalyst-to-heavy ratio defines the unit catalyst ratio.

2. The method of claim 1, further comprising transporting additional catalyst from the catalyst regenerator to the second reactor.

3. The method of claim 1, wherein both the first reactor and the second reactor are downers.

4. The method of claim 1, wherein both the first reactor and the second reactor are risers.

5. The method of claim 1, wherein the residence-time ratio is from about 1 to about 10.

6. The method of claim 1, wherein the unit catalyst ratio is from about 1 to about 10.

7. The method of claim 1, wherein the light fuel fraction comprises straight or cracked naphthas with boiling points from about 36° C. to about 250° C., distillate oils with boiling points from about 10° C. to about 400° C., or combinations thereof.

8. The method of claim 1, wherein the heavy fuel fraction comprises vacuum distillates with boiling points from about 370° C. to about 565° C., residues with boiling points above 520° C., or combinations thereof, the residues being chosen from hydrotreated residues, atmospheric distillation residues, vacuum distillation residues, visbreaking residues, distillation residues, or combinations thereof.

9. The method of claim 1, further comprising:

atomizing the light fuel fraction before feeding the light fuel fraction into the first reactor; and atomizing the heavy fuel fraction before feeding the heavy fuel fraction into the second reactor.

10. The method of claim 1, wherein the products are light olefins ($C_2$-$C_4$), and/or gasoline.

11. The method of claim 1, wherein the spent catalyst is separated from other products of the second reactor in a separation zone.

12. The method of claim 1, wherein the spent catalyst comprises coke deposits.

13. A system for cracking by fluidized catalytic cracking, the system comprising:

a first reactor comprising a catalyst inlet and a light fuel fraction inlet, wherein the first reactor is a fluidized bed reactor;

a second reactor in fluidic communication with the first reactor and comprising a heavy fuel fraction inlet, wherein the second reactor is a fluidized bed reactor, and wherein:

the first reactor and the second reactor are separated by a partition; or the first reactor is physically isolated from the second reactor;

a catalyst regenerator in fluidic communication with the catalyst inlet of the first reactor;

a catalyst that circulates from the catalyst regenerator to the first reactor to the second reactor and back to the catalyst regenerator;

a light fuel fraction disposed in the first reactor that reacts with the catalyst and is transported to the second reactor; and a heavy fuel fraction disposed in the second reactor that reacts with the catalyst.

14. The system of claim 13, further comprising a transfer line connecting the catalyst regenerator and the second reactor.

15. The system of claim 13, wherein both the first reactor and the second reactor are downers.

16. The system of claim 13, wherein both the first reactor and the second reactor are risers.

17. The system of claim 13, wherein the light fuel fraction in the first reactor is atomized.

18. The system of claim 13, wherein the light fuel fraction comprises straight or cracked naphthas with boiling points from about 36° C. to about 250° C., distillate oils with boiling points from about 10° C. to about 400° C., or combinations thereof.

19. The system of claim 13, wherein the heavy fuel fraction comprises vacuum distillates with boiling points from about 370° C. to about 565° C., residues with boiling points above 520° C., or combinations thereof, the residues being chosen from hydrotreated residues, atmospheric distillation residues, vacuum distillation residues, visbreaking residues, distillation residues, or combinations thereof.

20. The system of claim 13, wherein at least a portion of the catalyst in the second reactor is spent catalyst comprising coke deposits.

21. The method of claim 1, wherein the first reactor and the second reactor are separated by a partition.

22. The method of claim 1, wherein the first reactor is physically isolated from the second reactor.

23. The method of claim 22, wherein a connection line fluidly couples the first reactor and the second reactor.

24. The system of claim 13, wherein the first reactor and the second reactor are separated by the partition.

25. The system of claim 13, wherein the first reactor is physically isolated from the second reactor.

26. The method of claim 25, wherein a connection line fluidly couples the first reactor and the second reactor.

27. A method of cracking a light fuel fraction and a heavy fuel fraction by fluidized catalytic cracking, the method comprising:

feeding the light fuel fraction and a catalyst from a catalyst regenerator into a first reactor, wherein the first reactor is a fluidized bed reactor;

cracking the light fuel fraction in the first reactor to produce an at least partially cracked light fuel fraction;

transporting the at least partially cracked light fuel fraction and the catalyst from the first reactor to a second reactor, wherein the second reactor is a fluidized bed reactor; feeding the heavy fuel fraction into the second reactor;

cracking the heavy fuel fraction and the at least partially cracked light fuel fraction in the second reactor to produce at least a product fuel and a spent catalyst; and transporting the spent catalyst to the catalyst regenerator and regenerating the catalyst in the catalyst regenerator;

wherein:

the first reactor and the second reactor are separated by a partition; or the first reactor is physically isolated from the second reactor.

28. The system of claim 27, wherein the first reactor and the second reactor are separated by the partition.

29. The system of claim 27, wherein the first reactor is physically isolated from the second reactor.

30. The method of claim 29, wherein a connection line fluidly couples the first reactor and the second reactor.

31. The method of claim 27, further comprising transporting additional catalyst from the catalyst regenerator to the second reactor.

32. The method of claim 27, wherein both the first reactor and the second reactor are downers.

33. The method of claim 27, wherein both the first reactor and the second reactor are risers.

34. The method of claim 27, wherein the light fuel fraction comprises straight or cracked naphthas with boiling points from about 36° C. to about 250° C., distillate oils with boiling points from about 10° C. to about 400° C., or combinations thereof.

35. The method of claim 27, wherein the heavy fuel fraction comprises vacuum distillates with boiling points from about 370° C. to about 565° C., residues with boiling points above 520° C., or combinations thereof, the residues being chosen from hydrotreated residues, atmospheric distillation residues, vacuum distillation residues, visbreaking residues, distillation residues, or combinations thereof.

36. The method of claim 27, further comprising:

atomizing the light fuel fraction before feeding the light fuel fraction into the first reactor; and atomizing the heavy fuel fraction before feeding the heavy fuel fraction into the second reactor.

37. The method of claim 27, wherein the products are light olefins ($C_2$-$C_4$), and/or gasoline.

38. The method of claim 27, wherein the spent catalyst is separated from other products of the second reactor in a separation zone.

39. The method of claim 27, wherein the spent catalyst comprises coke deposits.

* * * * *